US005768837A

United States Patent [19]

Sjöholm

[11] Patent Number: 5,768,837

[45] Date of Patent: Jun. 23, 1998

[54] PROFILE STRUCTURE FOR GLAZING

[76] Inventor: Jarmo Sjöholm, Hovitie 20, FIN-01380 Vantaa, Finland

[21] Appl. No.: 696,937

[22] PCT Filed: Feb. 16, 1995

[86] PCT No.: PCT/FI95/00078

§ 371 Date: Aug. 19, 1996

§ 102(e) Date: Aug. 19, 1996

[87] PCT Pub. No.: WO95/22676

PCT Pub. Date: Aug. 24, 1995

[30] Foreign Application Priority Data

Feb. 21, 1994 [FI] Finland ..... U940110

[51] Int. Cl.[6] ..... E06B 1/04

[52] U.S. Cl. ..... 52/204.62; 52/204.66; 52/204.64; 52/204.69; 52/214

[58] Field of Search ..... 52/204.62, 204.64, 52/204.66, 204.69, 214

[56] References Cited

U.S. PATENT DOCUMENTS

| | | | |
|---|---|---|---|
| 2,883,717 | 4/1959 | Arnd | 52/204.62 |
| 4,479,331 | 10/1984 | Bertolami et al. | 52/204.69 X |
| 4,614,068 | 9/1986 | Bergthold | 52/214 X |
| 4,864,786 | 9/1989 | Harris, Jr. | 52/214 |
| 4,999,958 | 3/1991 | Harrison | 52/214 |

FOREIGN PATENT DOCUMENTS

| | | |
|---|---|---|
| 095 820 | 6/1983 | European Pat. Off. . |
| B 1259079 | 1/1968 | Germany . |
| B 1271361 | 6/1968 | Germany . |
| 26 48 175 | 9/1977 | Germany . |
| A 2202260 | 9/1988 | United Kingdom . |
| A 961216 | 6/1994 | United Kingdom . |

*Primary Examiner*—Wynn E. Wood

*Attorney, Agent, or Firm*—Merchant, Gould, Smith, Edell, Welter & Schmidt, P.A.

[57] ABSTRACT

A sectional structure, comprising a galzier's strip section (1) with a first side brace flange (2) for bracing one side of the glass pane, and a casing section (3) comprising a second side brace flange (4) for bracing the other side of the glass pane, a bottom rest (5) which is positioned at substantially right angles against the second side brace flange (4), the glass pane being disposed in the gap defined by the first and second side brace flanges and against the bottom rest. On the glazier's strip section (1) and on the casing section 93) have being formed mutually interlockable fixing members (6, 7). The structure comprises a first brace member (8), formed on the casing section (3), and a second brace member (9), formed on the glazier's strip section (1) for bracing against the first brace member (8) in order to form a pivot (10) between the sections so that with the first and second brace members (8, 9) urged against each other the glazier's strip section (1) can be turned around the pivot (10) constituted by the first and second brace members in cooperation for pressing the first side brace flange (2) against the surface of the pane in a substantially perpendicular direction into locked position, wherein the first and second locking claws (6, 7) become interlocked.

7 Claims, 1 Drawing Sheet

PROFILE STRUCTURE FOR GLAZING

FIELD OF THE INVENTION

The present invention concerns a sectional structure as defined in the preamble to claim 1.

BACKGROUND OF THE INVENTION

In prior art are known, e.g. through the references GB 2202260, EP 0 095 820, DE 26 48 175, sectional structures comprising a glazier's strip section having a first side brace flange for bracing one side of the glass pane, and a casing section comprising a second side brace flange for bracing the other side of the pane, and a bottom rest which is substantially perpendicular against the second side brace flange, the pane being held in the gap defined by the first and second side brace flanges and against the bottom rest when the sections have been attached to each other. For attachment, interlockable fixing 1 have been formed on the glazier's strip section and on the casing section which serve the detachable attachment of the glazier's strip section to the casing section. The fixing members comprise a first locking claw formed on the casing section, and a second locking claw, formed on the glazier's strip section to interlock with the first locking claw. The locking claws interlock with each other by a so-called snap joint.

The problem with these sectional structures of prior art is that the glazier's strip section cannot be attached to the casing section so that the first side brace flange of the glazier's strip section abutting on the surface of the pane would not slip in the direction of the pane surface when the glazier's strip section is being attached to the casing section. Slipping of the surfaces in relation to each other is particularly objectionable when the pane is fixed by cementing, when between them is interposed a layer of cement, which tends to become packed, between the surfaces in the direction of slip, causing the cement layer to become non-uniform.

An additional problem presented by the structure of reference GB 2202260 is that the glazier's strip section is not held firmly attached to the casing section without the pane between the side brace flanges, without a packing urged against the pane and without a flange provided on the glazier's strip section and urged against the surface of the window frame. In addition to the members just mentioned, the window frame is also required to hold the sections together. This implies that the sections cannot separately by themselves be connected with each other for cutting them off to desired length or for mitre cutting so that they would be held firmly together.

SUMMARY OF THE INVENTION

The object of the invention is to eliminate the drawbacks mentioned.

The device of the invention is characterized by that which is stated in claim 1.

As taught by the invention, the structure comprises a first brace member, formed on the casing section, and a second brace member, formed on the glazier's strip section for entering the first brace member so as to constitute a pivot between the sections in such manner that with the first and second brace members braced against each other the glazier's strip section can be turned about the pivot constituted by the first and second brace members in cooperation so as to press the first side brace flange against the surface of the pane in substantially perpendicular direction into a locked position, whereby the first and second lock claws become interlocked.

The invention affords the advantage that the glazier's strip section can be attached to the casing section so that the first side brace flange is urged in substantially perpendicular direction against the surface of the pane. Hereby the side brace flange will not come into sliding contact with the pane. There will thus be no displacement, or packing in any direction, of the cement layer e.g. on the side brace flange, and the cement layer will remain uniform. The glazier's strip section can be installed using a press which operates mechanically, e.g. pneumnatically or hydraulically. The glazing arrangement renders possible, in particular, easy attachment of the panes to the sections by cementing, implying that the panes need not be perforated, for instance, instead of which the attachment is based on the adhesive power of the cement. This is an advantage particularly in view of the durability of hardened glass, various stresses being produced around holes in hardened glass, which may result in breakage of the glass.

The invention affords the further advantage that the glazier's strip section and casing section can be coupled to each other without interposed glass pane and/or other bracing members, so that the sections can be cut off together e.g. to exactly equal length, or to a given mitre angle. The glazier's strip section and casing section can be cut to length prior to installing the pane, e.g. by sawing them as a unitary, joint assembly to mitre, i.e., an accurate corner joint can be established, and after the cutting operation the casing section and glazier's strip section can be separated with ease. Furthermore, when the sections are applied on the curved edge of a curved glass pane, the sections can be formed, coupled together, to have the same radius of curvature, before the glass pane is installed, The glazier's strip section is easy to detach from the casing section e.g. when replacing the pane.

In an embodiment of the sectional structure, the first side brace flange and the second side brace flange are provided with cement grooves longitudinal to the section, which receive cementing compound within themselves, whereby the elastic adhesive power of the cement will increase and the cement layer will be equalized if it has been non-uniformly applied. When the flanges are being pressed against the pane, the cement will escape into the grooves instead of being squeezed out over the margins of the flanges and onto the pane. It is thus obvious that the pane will not he soiled with cement.

In an embodiment of the sectional structure, the first brace member is an elongated flange with a convex sliding surface; the second brace member is an elongated flange with a fluted, concave sliding surface; and the curving configurations of the sliding surfaces are disposed to match each other.

In an embodiment of the sectional structure, the pivot constituted by the first and second brace members has been placed at a distance from the plane of the bottom rest in the direction away from the pane margin, and substantially close to the plane of that surface of the pane against which the first side brace flange of the glazier's strip section is urged. The glazier's strip section will then swivel around the pivot so that its side brace flange is urged against the surface of the pane in a direction as perpendicular as possible.

In an embodiment of the sectional structure, the casing section comprises a fixing member, such as a bolt groove or equivalent for receiving the head of a fixing bolt, in order to connect the casing section to a carrying structure, such as a frame, a hinge or a travelling member, such as a set of guide wheels or the like.

In an embodiment of the sectional structure, the second locking claw on the glazier's strip section is provided with an oblique first sliding surface and the first locking claw on the casing section is provided with an oblique second sliding surface, these first and Second sliding surfaces in cooperation facilitating the act of pushing the second locking claw over the first locking claw.

Advantageously, the glazier's strip section and/or the casing section are extruded of aluminium.

BRIEF DESCRIPTION OF THE DRAWINGS

Other advantageous features and details of the invention will be apparent from the description, following below, of an advantageous embodiment of the invention, which is described in detail, referring to the attached drawing, wherein.

DETAILED DESCRIPTION OF THE PREFERRED EMBODIMENT

Figure 1:
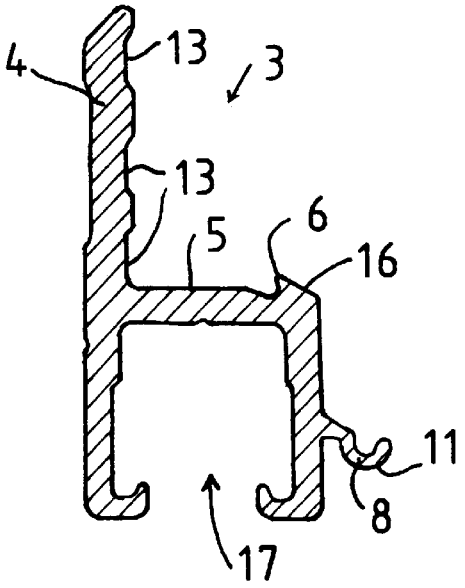
FIG. 1 presents the cross section of a casing section embodiment in an embodiment of the system of the invention.

FIG. 1 depicts the cross section of the casing section 3 of the sectional structure. The casing section 3 is an elongated sectional rail of which the cross section is uniform over its entire length. The casing section 3 is, for instance, extruded of aluminium through a nozzle die, whereby the configurations shown in FIG. 1 are produced all at once in connection with the manufacturing process.

Figure 2:
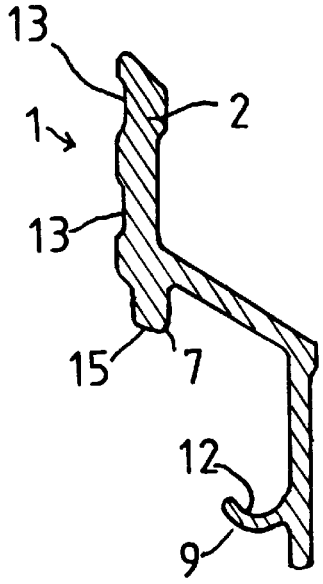
FIG. 2 presents the cross section of the glazier's strip section corresponding to the casing section embodiment of FIG. 1.

The glazier's strip section 1, in. FIG. 2, is also e.g. extruded of aluminium through a nozzle die, whereby the configurations shown in FIG. 2 are produced all at once in connection with the manufacturing process.

Figure 3:
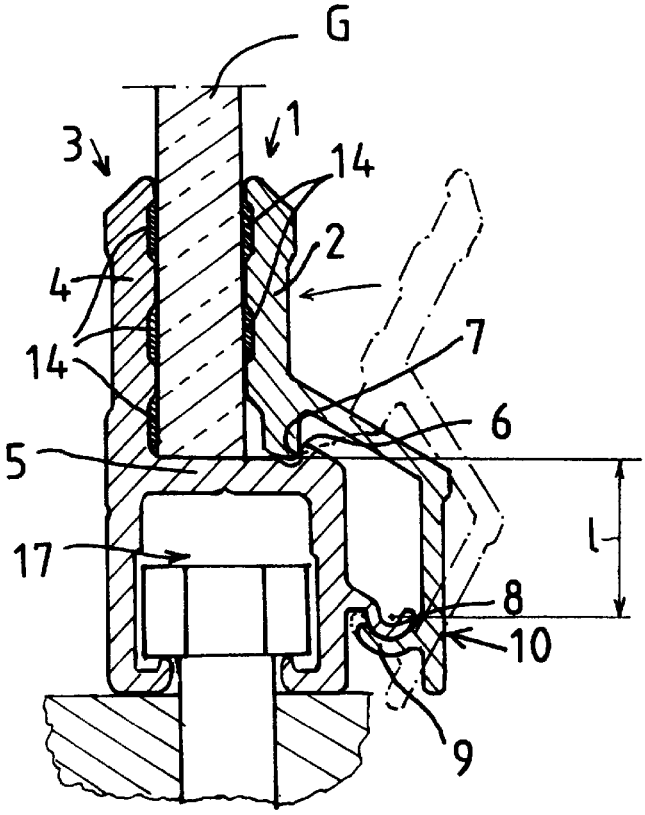
FIG. 3 presents the cross section of an assembly in which the casing section and glazier's strip section of FIGS. 1 and 2 have been connected to the pane.

The casing section 3 comprises a second side brace flange 4 for bracing one side of the glass pane G (see FIG. 3). Furthermore, the casing section 3 comprises a bottom rest 5, which is substantially at right angles against the second side brace flange 4, the glass pane G then being placeable, as shown in FIG. 3, in the angle between the second side brace flange 4 and the bottom rest 5. The glazier's strip section 1 of FIG. 2. carries a first side brace flange 2 for bracing the opposite side of the pane, whereby the glass pane G, on being mounted in the sectional structure, resides, as shown in. FIG. 3 in the gap defined by the first side brace flange 2 and the second side brace flange 4 and rests with its edge against the bottom rest 5.

On the glazier's strip section 1 and on the casing section 3 have been formed fixing members 6, 7 interlockable with each other for detachable attachment of the glazier's strip section 1 to the casing section 3. The fixing members comprise a first locking claw 6, formed on the casing section 3, and a second locking claw 7, formed on the glazier's strip section 1. The claws 6 and 7 constitute a quick joint of so-called snap-on type, enabling the sections 1 and 3 to be detachably locked to each other.

The structure comprises, in addition, a first brace member 8, formed on the casing section 3, and a second brace member 9, formed on the glazier's strip section 1 so that the second brace member 9 can be urged against the first brace member a in such manner that said brace members 8 and 9 constitute a kind of hinge like pivot 10 around which the glazier's strip section 1 can be swivelled with the brace members 8 and 9 resting against each other. In this example, the first brace member 8 is an elongated flange presenting a downward convex sliding surface 11. The second brace member 9 is similarly an elongated flange presenting an upward concave, fluted sliding surface 12. The curved configurations of the sliding surfaces 11,12 are disposed to match each other.

It is possible by turning the glazier's strip section 1 to convey the first side brace flange 2 of the glazier's strip section 1 against the glass pane G in a substantially perpendicular direction. The side brace flanges 2 and 4 are provided with longitudinal grooves 13, in which cementing compound 14 can be deposited. The grooves 13 increase the elastic adhesive power of the cement and they also contribute to levelling out non-uniform cement application, if such should occur.

When the first side brace flange 2 is brought against the glass pane G roughly perpendicularly the cementing compound 14 displays no tendency to move In any direction, and the cement layer will remain uniform. When the section 1 is pressed against the glass pane G, the locking claw 7 on the glazier's strip section 1, which presents a first oblique sliding surface 15, slips over the second oblique sliding surface 16 on the casing section, the section 1 yielding elastically, and the locking claw 7 stays behind the locking claw 6. In the locked position the glazier's strip section 1 remains in a stressed state.

The casing section 3 moreover comprises a fixing member 17, in the present instance a bolt slot shaped like a hammer head, in which the bolt head can be mounted, as shown in FIG. 3, and fixed to a suitable supporting structure, such as a frame, a hinge, etc. When the casing section system of the invention is applied in conjunction with balcony glass elements, one may equally in the slot 17 install a set of guide wheels or another equivalent travelling member.

The invention is not delimited to concern merely the embodiment examples presented in the foregoing: numerous modifications are feasible within the scope of the inventive idea defined by the claims.

What is claimed is:

1. A sectional structure, comprising;

a glazier's strip section having a first side brace flange for bracing one side of a glass pane;

a casing section having a second side brace flange for bracing the other side of the glass pane;

a bottom rest which is positioned at substantially a right angle with respect to the second side brace flange, the glass pane being disposed in a space defined by the first and second side brace flanges and the bottom rest;

the glazier's strip section and the casing section, formed mutually interlockable, having fixing means for detachably attaching the glazier's strip section to the casing section, said fixing means comprising a first locking claw, formed on the casing section, and a second locking claw, formed on the glazier's strip section for interlocking with the first locking claw;

a first brace member, formed on the casing section;

a second brace member, formed on the glazier's strip section, bracing against the first brace member which forms a pivot between the glazier's strip section and the casing section, wherein the glazier's strip section is pivotable between a locked position and an unlocked position, with the first and second brace members urged against each other, the glazier's strip section being turnable around the pivot constituted by the first and second brace members in cooperation, for pressing the first side brace flange against a surface of the glass pane into the locked position, wherein the first and second locking claws become interlocked.

2. A sectional structure according to claim 1, wherein the first side brace flange and the second side brace flange are provided with cement grooves longitudinal to the glazier's strip section and the casing section for receiving cementing compound, in order to increase elastic adhesion power of cement and to promote leveling of non-uniform cement application.

3. A sectional structure according to claim 1, wherein the first brace member is an elongated flange with a convex sliding surface, the second brace member is an elongated flange with a fluted, concave sliding surface, curved configurations of the sliding surfaces are disposed to match each other.

4. A sectional structure according to claim 1, wherein the pivot constituted by the first and second brace members is disposed at a distance from a plane of the bottom rest in a direction away from a margin of the glass pane and substantially close to the plane of that surface of the glass pane against which the first side brace flange of the glazier's strip section rests.

5. A sectional structure according to claim 1, wherein the casing section comprises a bolt slot, the bolt slot receiving a head of a fixing bolt, in order to connect the casing section to a supporting structure.

6. A sectional structure according to claim 1, wherein the second locking claw on the glazier's strip section is provided with an oblique first sliding surface, and the first locking claw on the casing section is provided with an oblique second sliding surface, the oblique first and second sliding surfaces in cooperation facilitating pushing of the second locking claw over the first locking claw.

7. A sectional structure according to claim 1, wherein at least one of the glazier's strip section and the casing section is extruded of aluminum.

* * * * *

UNITED STATES PATENT AND TRADEMARK OFFICE
CERTIFICATE OF CORRECTION

PATENT NO. : 5,768,837

DATED : JUNE 23, 1998

INVENTOR(S) : SJÖHOLM

It is certified that error appears in the above-identified patent and that said Letters Patent is hereby corrected as shown below:

Col. 1, line 17: "1" should read —members—

Col. 3, line 5: "Second" should read —second—

Col. 4, line 1: the word "a" should read —8—

Col. 4, line 22: "In" should read —in—

Signed and Sealed this

Twenty-fourth Day of August, 1999

*Attest:*

Q. TODD DICKINSON

*Attesting Officer*

*Acting Commissioner of Patents and Trademarks*